US008905781B2

(12) United States Patent
Chen

(10) Patent No.: US 8,905,781 B2
(45) Date of Patent: Dec. 9, 2014

(54) COAXIAL ELECTRICAL CONNECTOR HAVING RETAINING ARMS AND COAXIAL ELECTRICAL CONNECTOR ASSEMBLY HAVING THE SAME

(71) Applicant: De-Jin Chen, ShenZhen (CN)

(72) Inventor: De-Jin Chen, ShenZhen (CN)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 98 days.

(21) Appl. No.: 13/712,996

(22) Filed: Dec. 13, 2012

(65) Prior Publication Data

US 2013/0149887 A1 Jun. 13, 2013

(30) Foreign Application Priority Data

Dec. 13, 2011 (CN) ..... 2011 1 0413972

(51) Int. Cl.

| | |
|---|---|
| ***H01R 9/05*** | (2006.01) |
| ***H01R 13/627*** | (2006.01) |
| ***H01R 24/50*** | (2011.01) |
| *H01R 13/6582* | (2011.01) |
| *H01R 103/00* | (2006.01) |

(52) U.S. Cl.

CPC ..... *H01R 13/627* (2013.01); *H01R 13/6275* (2013.01); *H01R 13/6582* (2013.01); *H01R 24/50* (2013.01); *H01R 2103/00* (2013.01)

USPC ..... 439/581; 439/63

(58) Field of Classification Search

CPC ..... H01R 2103/00; H01R 24/50

USPC ..... 439/581, 582, 63, 578

See application file for complete search history.

(56) References Cited

U.S. PATENT DOCUMENTS

| | | | | |
|---|---|---|---|---|
| 5,772,470 | A * | 6/1998 | Togashi | 439/582 |
| 6,447,335 | B1 * | 9/2002 | Ko | 439/585 |
| 6,503,100 | B2 | 1/2003 | Yamane | |
| 6,607,400 | B1 * | 8/2003 | Ko | 439/581 |
| 7,581,958 | B2 * | 9/2009 | Swanson et al. | 439/63 |
| 7,648,394 | B2 * | 1/2010 | Yotsutani | 439/581 |
| 8,414,328 | B2 * | 4/2013 | Yamakoshi et al. | 439/582 |
| 2009/0149063 | A1 * | 6/2009 | Yotsutani | 439/578 |

* cited by examiner

*Primary Examiner* — Hae Moon Hyeon

(74) *Attorney, Agent, or Firm* — Wei Te Chung; Ming Chieh Chang

(57) ABSTRACT

A coaxial connector assembly comprises a cable coaxial electrical connector and a board coaxial electrical connector mounted on a PCB and connecting to the cable coaxial electrical connector. The cable coaxial electrical connector defines a pair of retaining arms extending toward the board coaxial electrical connector, thereby the pair of retaining arms locking with the board coaxial electrical connector or the PCB to ensure a good engagement of the two coaxial connectors.

17 Claims, 5 Drawing Sheets

COAXIAL ELECTRICAL CONNECTOR HAVING RETAINING ARMS AND COAXIAL ELECTRICAL CONNECTOR ASSEMBLY HAVING THE SAME

BACKGROUND OF THE INVENTION

1. Field of the Invention

The present invention relates to a coaxial electrical connector and a coaxial electrical connector assembly, and more particularly to a coaxial electrical connector having retaining arms.

2. Description of the Related Art

U.S. Pat. No. 6,503,100, issued on Jan. 7, 2003, discloses a related cable coaxial electrical connector which includes a cable and a coaxial electrical connector connected to the cable. Said cable coaxial electrical connector includes an insulative housing, a terminal is received in the insulative housing and a shielded shell covering the insulative housing. The insulative housing includes a mating face and a bottom face opposite to the mating face, a passageway runs through the mating face and the bottom face and the terminal is received in the passageway. The shielded shell includes a ring portion and a shielding portion, said ring portion covering the circumference of the insulative housing and the shielding portion is pressed against the bottom face of the insulative housing for retaining the terminal in the passageway. Said cable coaxial electrical connector is generally connected to a board coaxial electrical connector and the board coaxial electrical connector is mounted on a printed circuit board. Said board coaxial electrical connector includes an insulative housing, a terminal is received in the insulative housing and a shielded shell covering the insulative housing, the shielded shell of the board coaxial electrical connector also includes a ring portion and a shielding portion, said the cable coaxial electrical connector defines a rib on the circumference of the shielded shell and the board coaxial electrical connector defines a groove on the circumference of the shielded shell, the rib is fit into the groove when the cable coaxial electrical connector connected with the board coaxial electrical connector. However, there have not a good engagement of the two coaxial electrical connectors because of the cable coaxial electrical connector and the board coaxial electrical connector is very small.

Therefore, there is a need to provide a coaxial electrical connector assembly to resolve the above-mentioned problem.

SUMMARY OF THE INVENTION

A coaxial electrical connector includes an insulative housing, a terminal and a shielded shell, the shielded shell covering the insulative housing and the terminal is received in the insulative housing. Said shielded shell has a ring portion and defining a bottom face and a mating face opposite to the bottom face, said terminal has a contacting section located in a inner side of the ring portion of the shielded shell, a retaining arm is formed on a outer side of the bottom face of the shielded shell and extend to the mating face.

Other features and advantages of the present invention will become more apparent to those skilled in the art upon examination of the following drawings and detailed description of preferred embodiments, in which:

DETAILED DESCRIPTION OF PREFERRED EMBODIMENT

Figure 1:
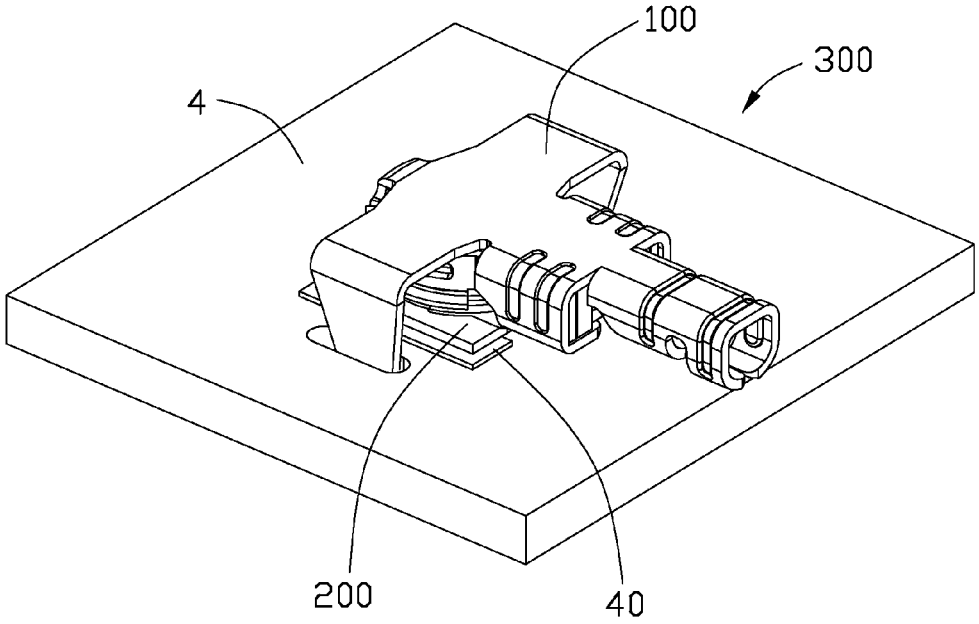
FIG. 1 is a perspective view of a coaxial electrical connector assembly in accordance with the present invention.
Figure 2:
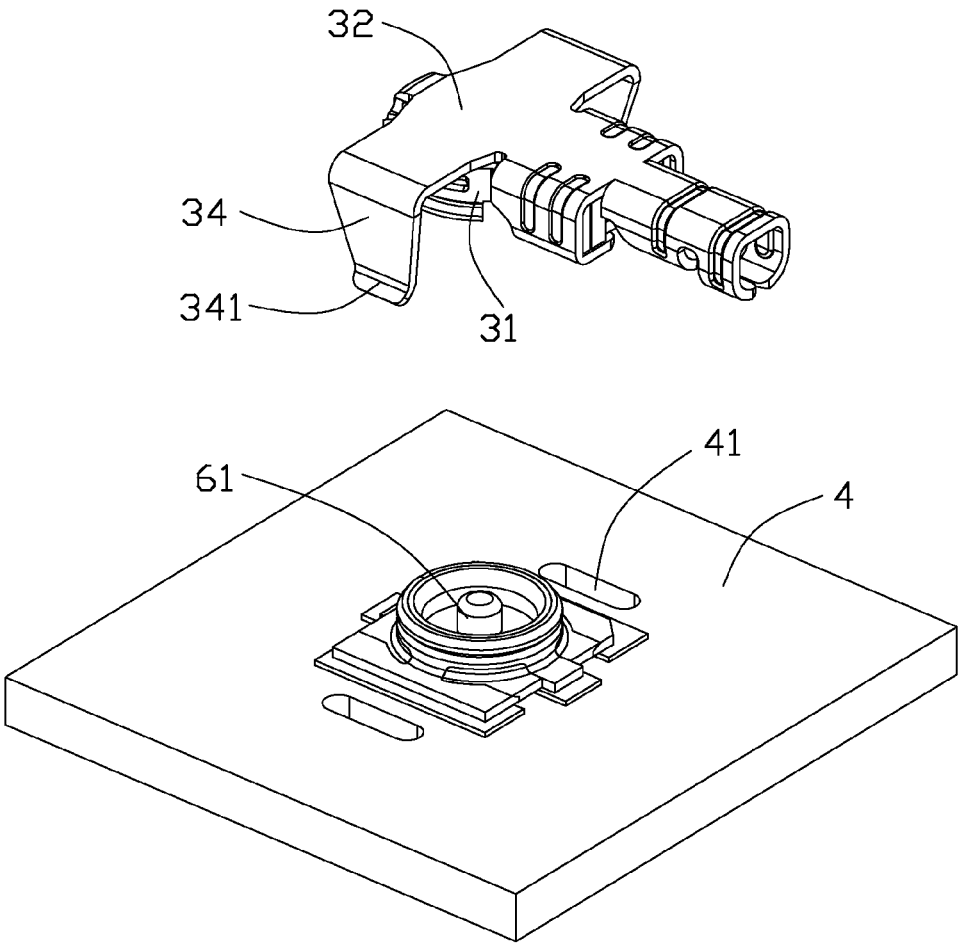
FIG. 2 is an assembled, perspective view of a board coaxial electrical connector and a cable coaxial electrical connector pulled out of the board coaxial electrical connector.

Referring to FIGS. 1 to 2, a coaxial electrical connector assembly 300 comprises a cable coaxial electrical connector 100 and a board coaxial electrical connector 200 matched with the cable coaxial electrical connector 100, said board coaxial electrical connector 200 is mounted on a printed circuit board 4.

Figure 3:
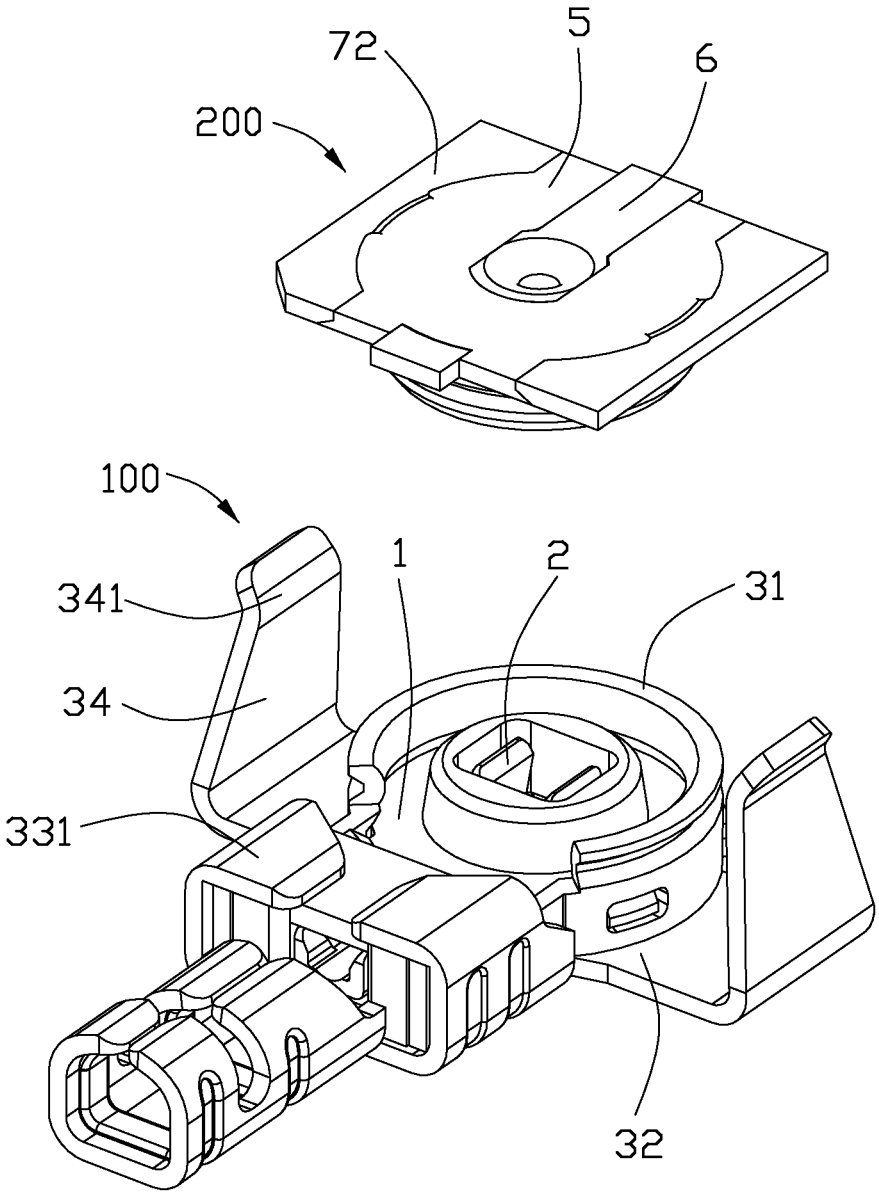
FIG. 3 is another perspective view of the board coaxial electrical connector and the cable coaxial electrical connector shown in FIG. 2.
Figure 4:
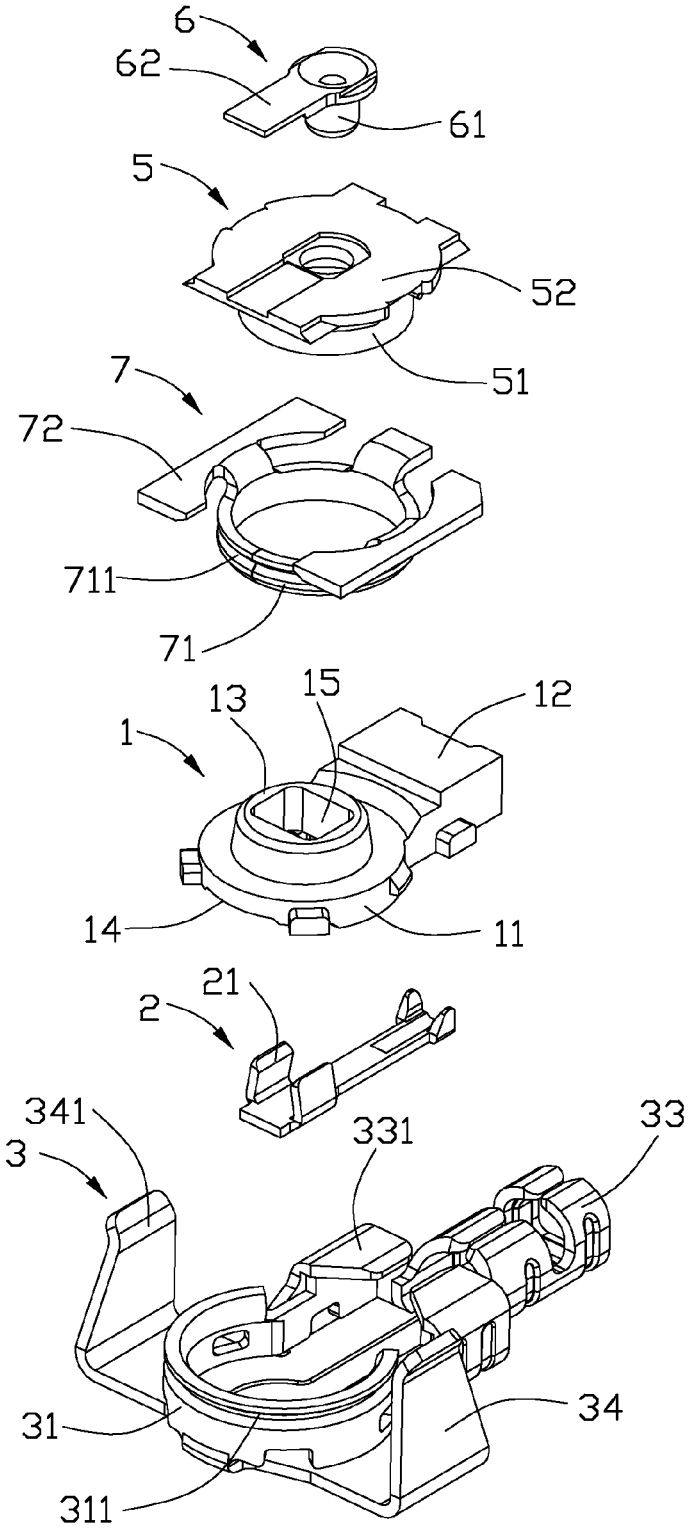
FIG. 4 is an exploded perspective view of the cable coaxial electrical connector and the board coaxial electrical connector shown in FIG. 3.

Referring to FIGS. 3 to 4, said cable coaxial electrical connector 100 includes an insulative housing 1, a terminal 2 is received in the insulative housing 1 and a shielded shell 3 covering the insulative housing 1. The insulative housing 1 defines a body section 11 having a cylindrical shape and a retaining section 12 connecting to the body section 11; a cable (shown in the dashed line in FIG. 1) is retained on the retaining section 12. Said body section 11 defines a mating face 13 and a bottom face 14 opposite to the mating face 13, the insulative housing 1 forms a passageway 15 running through the mating face 13 and the bottom face 14 to receive the terminal 2. Said terminal 2 is attached to the bottom face 14 and connected with the cable (not shown), a pair of contacting sections 21 are formed on one side of the terminal 2 and extend into the passageway 15. The shielded shell 3 defines a ring portion 31 covering the body section 11 of the insulative housing 1, a shielding portion 32 pressing against the bottom face 14 to prevent the terminal 2 from coming off the insulative housing 1 and a retaining portion is clamping the cable (not shown) and the retaining section 12. The shielded shell 3 also define a pair of clamping pieces 331 and said insulative housing 1 is further retained by said clamping pieces 331, said contacting sections 21 of the terminal 2 are located in a inner side of the ring portion 31 of the shielded shell 3.

Said board coaxial electric connector 200 defines an insulative housing 5, a terminal 6 received in the insulative housing 5 and a shielded shell 7 covering the insulative housing 5. The insulative housing 5 defines a body section 51 having a cylindrical shape and a base section 52 located on a bottom face of the body section 51, the terminal 6 defines a contacting section 61 having a cylindrical shape and a flat-shaped soldering section 62, said soldering section 62 extends along the bottom face of the base section 52 and is soldered to the printed circuit board 4. The shielded shell 7 defines a ring portion 71 covering the body section 51 and a pair of soldering portions 72 extending on opposite sides of the ring portion 71. Said printed circuit board 4 defines conductive sheet 40 connected to the soldering portion 72 and the soldering section 62 for forming electrical connection. An annular rib 311 is located on the circumference of the ring portion 31 of the shielded shell 31 and further located on the inner side of the ring portion 31, an annular notch 711 is located on the circumference of the ring portion 71 of the shielded shell 7 and further located on an outer side of the ring portion 71, said terminal 2 connect to the terminal 6 and annular rib 311 lock with the annular notch 711 when the cable coaxial electrical connector 100 matches with the board coaxial electrical connector 200.

A retaining arm 34 is formed on an outer side of the bottom face of the ring portion 31. Said retaining arm 34 extends to the mating face and further protrudes out of the mating face, said retaining arm 34 can increase mating force between the cable coaxial electrical connector 100 and the board coaxial electrical connector 200.

Referring to FIGS. 2 to 3, a first embodiment of the present invention, the shielding portion 32 of the cable coaxial electrical connector 100 protrudes out of the side of the ring portion 31 and bend downwardly to form said retaining arm 34, said retaining arm 34 is defined on the outer side of the cable coaxial electrical connector 100 and further extends towards the board coaxial electrical connector 200. Said shielding portions 32 extend outwardly from opposite sides of the ring portion 31, said two retaining arms 34 on opposite sides of the shielding portion 32 extend slant to each other. Said board coaxial electrical connector 200 defines a pair of locking grooves 41 for receiving the retaining arms 34, said two locking grooves 41 are symmetrically arranged and said retaining arms are also symmetrically arranged. When said cable coaxial electrical connector 100 matches with said board coaxial electrical connector 200, said retaining arms 34 are locked into said locking grooves 41 so as to increase mating force between the cable coaxial electrical connector 100 and the board coaxial electrical connector 200. A distance between said two retaining arms 34 is smaller than a distance between said two locking grooves 41. An arc portion 341 is formed on a free end of the retaining arm 34 for easily inserting and taking out the retaining arm 34 from the locking groove 41. An extending direction of the shielding portion 32 is perpendicular to the retaining portion 33 and an extending direction of the retaining arm 34 is perpendicular to the retaining portion 33, said retaining arms 34 are also used for picking up the cable coaxial electrical connector 100. Each said locking groove 41 is connected to a grounding path, each said retaining arm 34 is integrally formed on the shielded shell 3, said cable coaxial electrical connector can be reliably grounded when the retaining arms 34 are locked into the locking grooves 41.

Figure 5:
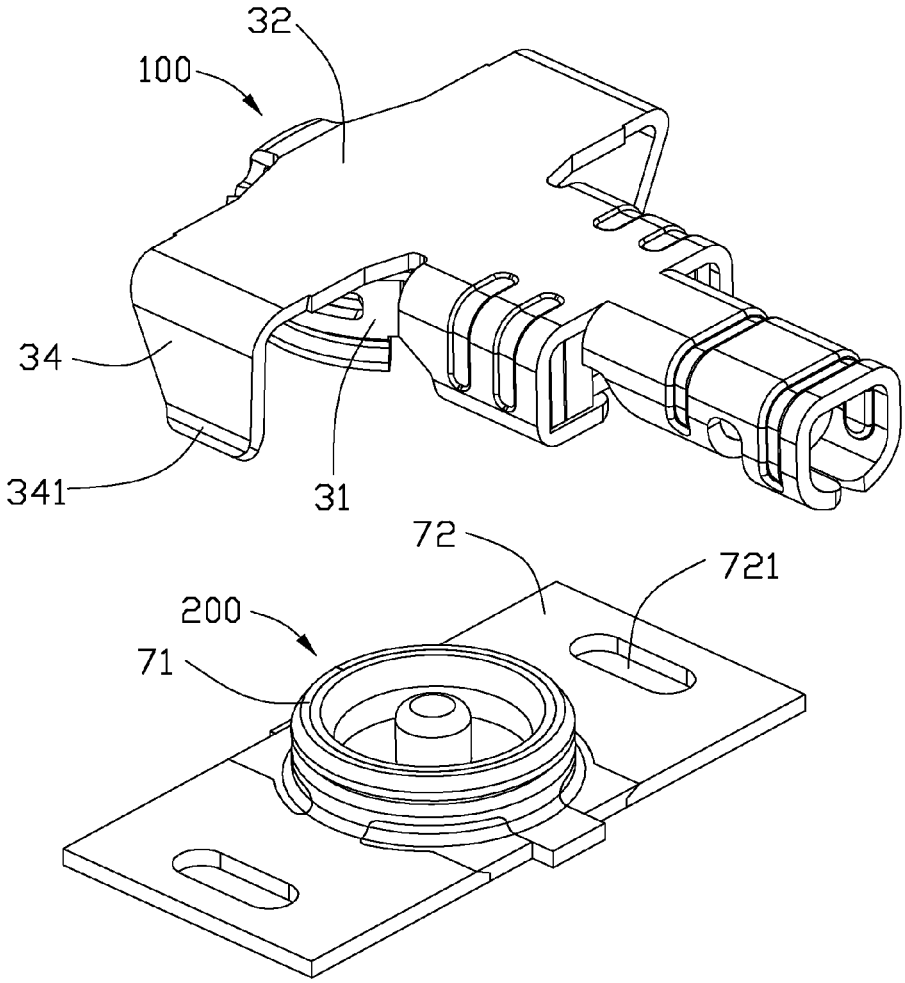
FIG. 5 is a perspective view of a second embodiment of a coaxial electrical connector in accordance with the present invention for mating with the cable coaxial electrical connector shown in FIG. 2.

Referring to FIG. 5, a second embodiment of the present invention, said board coaxial electrical connector 200 defines a pair of locking grooves 721 nearing the printed circuit board 4. For example, The pair of soldering portions 72 are extend longer and said locking grooves 721 are defined on said soldering portion 72, said retaining arms 34 are locked into the locking grooves 721.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A coaxial electrical connector, comprising:

an insulative housing;

a shielded shell covering the insulative housing, said shielded shell having a ring portion and defining a bottom face and a mating face opposite to the bottom face;

a terminal retained in the insulative housing; said terminal has a contacting section located in an inner side of the ring portion of the shielded shell;

wherein a pair of retaining arms are formed on two opposite sides of the bottom face of the ring portion and extend to the mating face, wherein said retaining arm protrudes beyond the mating face, the shielded shell defines a shielding portion pressing against a bottom face of the insulative housing, said shielding portion extends out of a side of the ring portion and bends downwardly to form the retaining arm.

2. The coaxial electrical connector as claimed in claim 1, wherein a cable is connect to said terminal, said shielded shell defines a retaining portion for retaining the cable, an extending direction of the shielding portion is perpendicular to the retaining portion and an extending direction of the retaining arm is perpendicular to the retaining portion.

3. The coaxial electrical connector as claimed in claim 2, wherein said shielding portion extends out of opposite sides of the ring portion and the retaining arms on opposite sides extending slant to each other.

4. The coaxial electrical connector as claimed in claim 3, wherein an arc portion is formed on a free end of the retaining arm.

5. A coaxial electrical connector assembly, comprising:

a cable coaxial electrical connector;

a board coaxial electrical connector matching with the cable coaxial electrical connector, said board coaxial electrical connector being mounted on a printed circuit board;

wherein a retaining arm is formed on an outer side of the cable coaxial electrical connector and said retaining arm extends towards the board coaxial electrical connector, said retaining arm is retained on the board coaxial electrical connector or the printed circuit board, wherein a pair of locking grooves are formed on the opposite sides of the board coaxial electrical connector or the printed circuit board for receiving the retaining arm.

6. The coaxial electrical connector assembly as claimed in claim 5, wherein said cable coaxial electrical connector defines an insulative housing and a shielded shell covering the insulative housing, the shielded shell defines a bottom face and a mating face opposite to the bottom face, a pair of retaining arms are formed on opposite sides of the bottom face of the shielded shell and extend out of the mating face.

7. The coaxial electrical connector assembly as claimed in claim 6, wherein a distance between said two retaining arms is smaller than a distance between said two locking grooves.

8. A coaxial cable connector assembly for mounting a printed circuit board, comprising:

an insulative housing defining a downward facing passageway in a vertical direction;

a contact disposed in the housing with a contacting section exposed in the passageway;

a wire extending in a front-to-back direction perpendicular to said vertical direction, and connected to a rear portion of the contact;

a metallic shell assembled to the housing and defining a front ring portion to cooperate with the housing to form a downward circular mating port, and a rear clamping portion to fasten the shell to the housing; wherein at least one metallic retaining arm connected to the shell and extending downwardly beside said ring portion, adjacent a bottom face of the housing and beyond said circular mating port for mounting to the printed circuit board.

9. The coaxial cable connector assembly as claimed in claim 8, wherein said retaining arm is located by said ring portion in a transverse direction perpendicular to both said vertical direction and said front-to-back direction.

10. The coaxial cable connector assembly as claimed in claim 8, wherein said retaining arm is unitarily formed with said shell.

11. The coaxial cable connector assembly as claimed in claim 10, wherein said shell defines a horizontal shielding portion covering said ring porting portion in the vertical direction, and said ring portion is unitarily linked at a front edge of the shielding portion while said retaining arm is unitarily linked at a lateral edge of the shielding portion, said front edge being perpendicular to said lateral edge.

12. The coaxial cable connector assembly as claimed in claim 8, further including another metallic retaining arm cooperating with said retaining arm to be located distantly by two opposite sides of the ring portion in a transverse direction perpendicular to both said vertical direction and said front-to-back direction.

13. The coaxial cable connector assembly as claimed in claim 12, wherein said shell includes a horizontal shielding portion covering the ring portion in the vertical direction, and said metallic retaining arm and said another metallic retaining arm extend downwardly from two opposite lateral sides of the shielding portion to form a T-shaped structure in a top view.

14. The coaxial cable connector assembly as claimed in claim 13, wherein a dimension of said shielding portion in the transverse direction is at least twice of a diameter of the ring portion.

15. The coaxial cable connector assembly as claimed in claim 8, wherein said shell further includes a retaining portion to fasten to the wire.

16. The coaxial cable connector assembly as claimed in claim 8, wherein said retaining arm extends in the front-to-back direction and deflectable in a transverse direction perpendicular to both said vertical direction and said front-to-back direction.

17. The coaxial cable connector assembly as claimed in claim 8, further including a board connector located under the housing and mated within the mating port for mounting to the printed circuit board, wherein said retaining arm is located beside the board connector in a transverse direction perpendicular to both said vertical direction and said front-to-back direction.

* * * * *